US008246294B2

(12) United States Patent
Rosenfield et al.

(10) Patent No.: US 8,246,294 B2
(45) Date of Patent: Aug. 21, 2012

(54) GAS TURBINE OVERSPEED PROTECTION SYSTEM

(75) Inventors: Ronald H. Rosenfield, San Diego, CA (US); Wayne T. Tran, San Diego, CA (US); Charles Spatafore, Poway, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1255 days.

(21) Appl. No.: 12/014,667

(22) Filed: Jan. 15, 2008

(65) Prior Publication Data

US 2008/0213084 A1 Sep. 4, 2008

Related U.S. Application Data

(60) Provisional application No. 60/880,685, filed on Jan. 16, 2007.

(51) Int. Cl.
*F01D 17/06* (2006.01)

(52) U.S. Cl. ..... 415/30; 700/290; 702/142

(58) Field of Classification Search ..... 700/90, 700/304, 290; 73/112.01, 114.01, 114.25; 702/1, 33, 34, 127, 142, 182; 415/30
See application file for complete search history.

(56) References Cited

U.S. PATENT DOCUMENTS 6,578,794 B1 * 6/2003 Clark et al. ..... 244/75.1
* cited by examiner

*Primary Examiner* — Dwayne J White
(74) *Attorney, Agent, or Firm* — Stephen G. Mican

(57) ABSTRACT

An overspeed protection system for a gas turbine engine comprises: a plurality of engine speed sensors that generate engine speed signals; and a plurality of engine overspeed detection channels, each channel comprising an overspeed detector that receives and generates an overspeed signal when it detects the engine speed signal exceeding a selected value of overspeed.

16 Claims, 7 Drawing Sheets

GAS TURBINE OVERSPEED PROTECTION SYSTEM

CROSS REFERENCE TO RELATED APPLICATIONS

This Application relates to the subject matter described in Provisional Patent Application Ser. No. 60/880,685 filed 16 Jan. 2007 and claims the benefit of the filing date there for.

FIELD OF THE INVENTION

The invention relates to gas turbine speed regulation systems, and more particularly to systems that protect gas turbine engines from overspeed conditions.

BACKGROUND OF THE INVENTION

Gas turbine engines operate at high rotational velocities in normal operation, typically at tens of thousands of revolutions per minute (RPM). Operation at such high rotational velocities creates significant centrifugal force on the rotational members of such gas turbine engines, which force increases as the square of the rotational velocity. Therefore, to avoid catastrophic breakdown, a gas turbine engine should not ordinarily operate above its normal rotational velocity.

Consequently, a gas turbine engine may have an overspeed protection system that monitors overspeed conditions and shuts down the engine upon sensing such conditions. Typically, modern overspeed protection systems are microprocessor based and rely on appropriate software for their operation. Of course, the operational reliability of such systems is dependent upon the reliability of such software and the data storage equipment that stores and reads it. In some critical applications, dependence on such software and its associated data storage equipment is unsatisfactory or excessively expensive due to regulatory certification costs.

SUMMARY OF THE INVENTION

The invention generally comprises an overspeed protection system for a gas turbine engine, comprising: a plurality of engine speed sensors that generate engine speed signals; and a plurality of engine overspeed detection channels, each channel comprising an overspeed detector that receives and generates an overspeed signal when it detects the engine speed signal exceeding a selected value of overspeed.

DETAILED DESCRIPTION OF THE INVENTION

Figure 1:
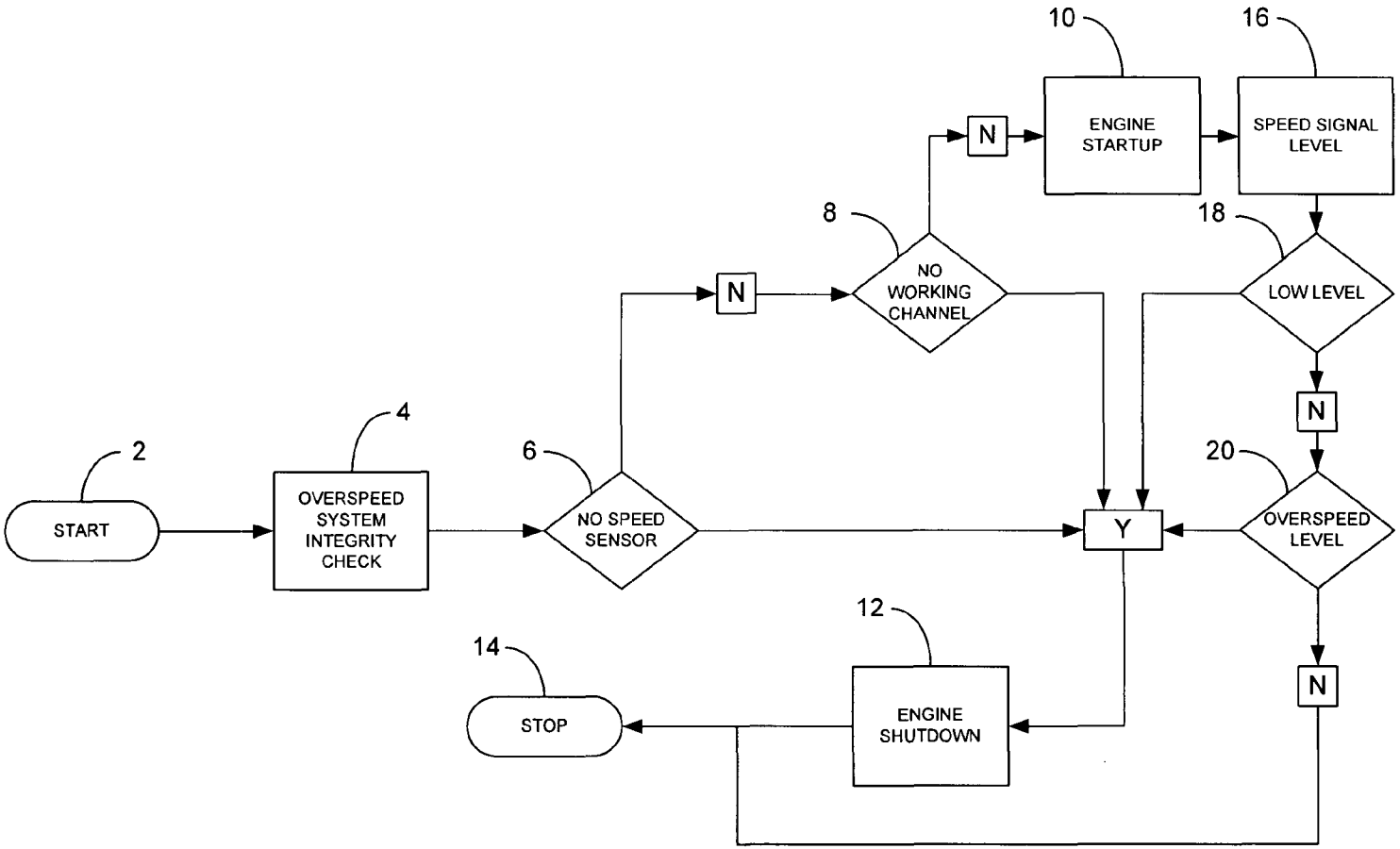
FIG. 1 is a high level flow chart for a gas turbine overspeed protection process according to a possible embodiment of the invention.

FIG. 1 is a high level flow chart for a gas turbine overspeed protection process according to a possible embodiment of the invention. The process comprises a step of testing a plurality of independent engine speed signal sources and a step of testing a plurality of independent overspeed detection paths or channels. The process starts with a process start initiation 2 that enables an overspeed system integrity check process 4 that comprises a step of testing the integrity of a plurality of independent engine speed signal sources testing the integrity of a plurality of independent engine speed signal overspeed detection paths. If the engine speed signal source integrity step indicates at least a selected number of good engine speed signals, but at least one, as indicated by decision block 8 and the overspeed detection channel integrity step indicates at least a selected number of good engine speed signal overspeed detection paths, but at least one, connected to the selected number of good engine speed signals as indicted by decision block 10, this combination enables an engine startup process 12 that comprises a step of supplying fuel to the engine. If the engine speed signal integrity step indicates less than the selected number of good engine speed signals or the engine speed signal overspeed detection path detection process indicates less than the selected number of good engine speed signal overspeed detection paths, these steps may enable an engine shutdown process 12 that comprises a step of blocking fuel from the engine, leading to a process stop termination 14.

The engine startup process 10 enables an engine speed signal detection process 16 that comprises a step of detecting the signal level of at least the selected number of at least the selected number of good engine speed signal sources that propagate through at least the selected number of good engine overspeed detection paths. If the engine speed signal detection process 16 indicates that the signal level of at least the selected number of good engine speed signal sources is below an acceptable level as indicated by decision block 18, it enables the engine shutdown process 12, leading to the process stop termination 14. Otherwise, the engine speed signal detection process 16 determines if the signal level represents an overspeed condition as indicated by decision block 20. If so, it enables the engine shutdown process 12, leading to the process stop termination 14. If not, engine operation continues until another operation or event enables the process stop termination 14.

Figure 2:
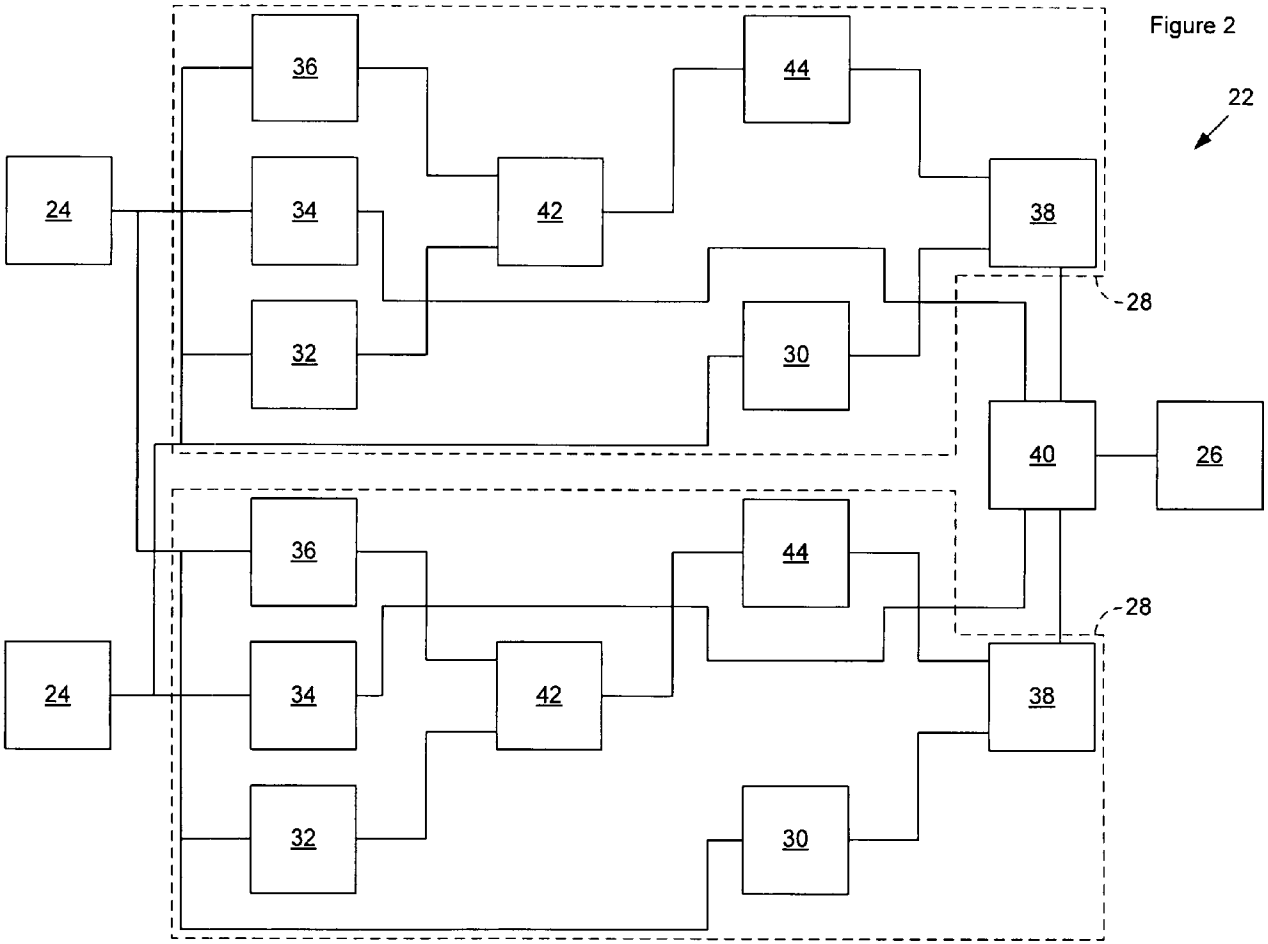
FIG. 2 is a high level schematic diagram of a gas turbine overspeed protection system according to a possible embodiment of the invention.

FIG. 2 is a high level schematic diagram of a possible embodiment of a hardware-based gas turbine overspeed protection system 22 that may implement the gas turbine overspeed protection process as generally hereinbefore described in connection with FIG. 1. The overspeed protection system 22 comprises at least a selected number of redundant engine speed sensors 24 for a gas turbine engine 26, but at least two as shown, that have engine speed output signals that connect to a selected number of engine overspeed detection paths or channels 28, but at least two as shown. A sensor output detector 30, an intermediate speed detector 32, a low amplitude speed signal detector 34 and an overspeed detector 36 in each overspeed detection channel 28 receive the engine speed output signal from at least one, but preferably at least two of the engine speed sensors 24 as shown.

If at least one of the sensor output detectors 30 detects no engine speed output signal from any of the engine speed sensors 24 upon startup of the engine 26, it generates a sensor output error signal. An engine speed error controller 38 receives the sensor output error signal from the sensor output detector 30 and generates a termination signal. An engine controller 40 receives the termination signal from the engine speed error controller 38 and generates an engine shutdown signal that shuts down the gas turbine engine 26.

As long as none of the sensor output detectors 30 detect loss of engine speed signals, the startup of the engine 26 continues. The intermediate speed detectors 32 generate an intermediate speed signal when they detect the engine speed signals exceeding a selected intermediate engine speed. The sensor output detectors 30 monitor the same engine speed signal as the intermediate speed detectors 32. Once the engine 26 is running at the intermediate speed, the low amplitude speed signal detector 34 can detect if the speed sensor signal has a level lower than a threshold level considered adequate for reliable speed detection. If so, it generates a termination signal, the engine controller 40 receives the termination signal and it shuts down the gas turbine engine 26.

The overspeed detectors 36 generate an overspeed signal when they detect the engine speed signals exceeding a selected value of overspeed. A multiplexer 42 receives the overspeed signal from its associated overspeed detector 36 and the intermediate speed signal from its associated intermediate signal detector 32. The multiplexer 42 is selectable between the overspeed signal and the intermediate speed signal by way of a test mode. When in normal mode, the multiplexer 42 accepts the overspeed signal to generate an overspeed error signal. When in the test mode, the multiplexer 42 accepts the intermediate signal to generate the overspeed error signal. An overspeed condition detector 44 receives the overspeed error signal from its associated multiplexer 42 and generates an overspeed condition signal. The engine speed error controller 40 receives the overspeed condition signal from its associated overspeed condition detector 44 and generates a termination signal as hereinbefore described, the engine controller 40 receives the termination signal and it shuts down the gas turbine engine 26.

The test mode allows the overspeed protection system 22 to test the engine overspeed detection channels 28 without actually overspeeding the gas turbine engine 26. Also, setting at least one of the multiplexers 42 to test mode is a convenient method of shutting down the gas turbine engine 26.

If the speed of the gas turbine engine 26 falls to a level below the selected intermediate speed after reaching an overspeed condition, the multiplexer 42 in each engine overspeed detection channel 28 then ceases to generate an overspeed error signal. The associated overspeed condition detector 44 then ceases to generate a termination signal and the gas turbine engine 26 may continue operation.

To avoid having software deciding the condition of the engine speed sensors 24, upon startup the overspeed protection system 22 may set the multiplexers 42 to the test mode and inject a test signal in place of the engine speed sensor signal for each of the engine speed sensors 24 that causes the intermediate speed detectors 32 to generate intermediate speed signals that in turn make the multiplexers 42 generate overspeed error signals. This test initiates at each start up of the gas turbine engine 26.

FIG. 2 illustrates that each of the engine speed sensors 24 connect to each of the engine overspeed detection channels 28 so that the overspeed protection system 22 may still function with the loss of either engine speed sensor 24 and either engine overspeed channel 28. Alternatively, each engine overspeed detection channel 28 may have its own dedicated engine speed sensor 24 so that each engine overspeed detection channel 28 only monitors the output of its associated engine speed sensor 24. Furthermore, the overspeed protection system 22 may have any number of such overspeed detection channels 28 with dedicated engine speed sensors 24.

Figure 3:
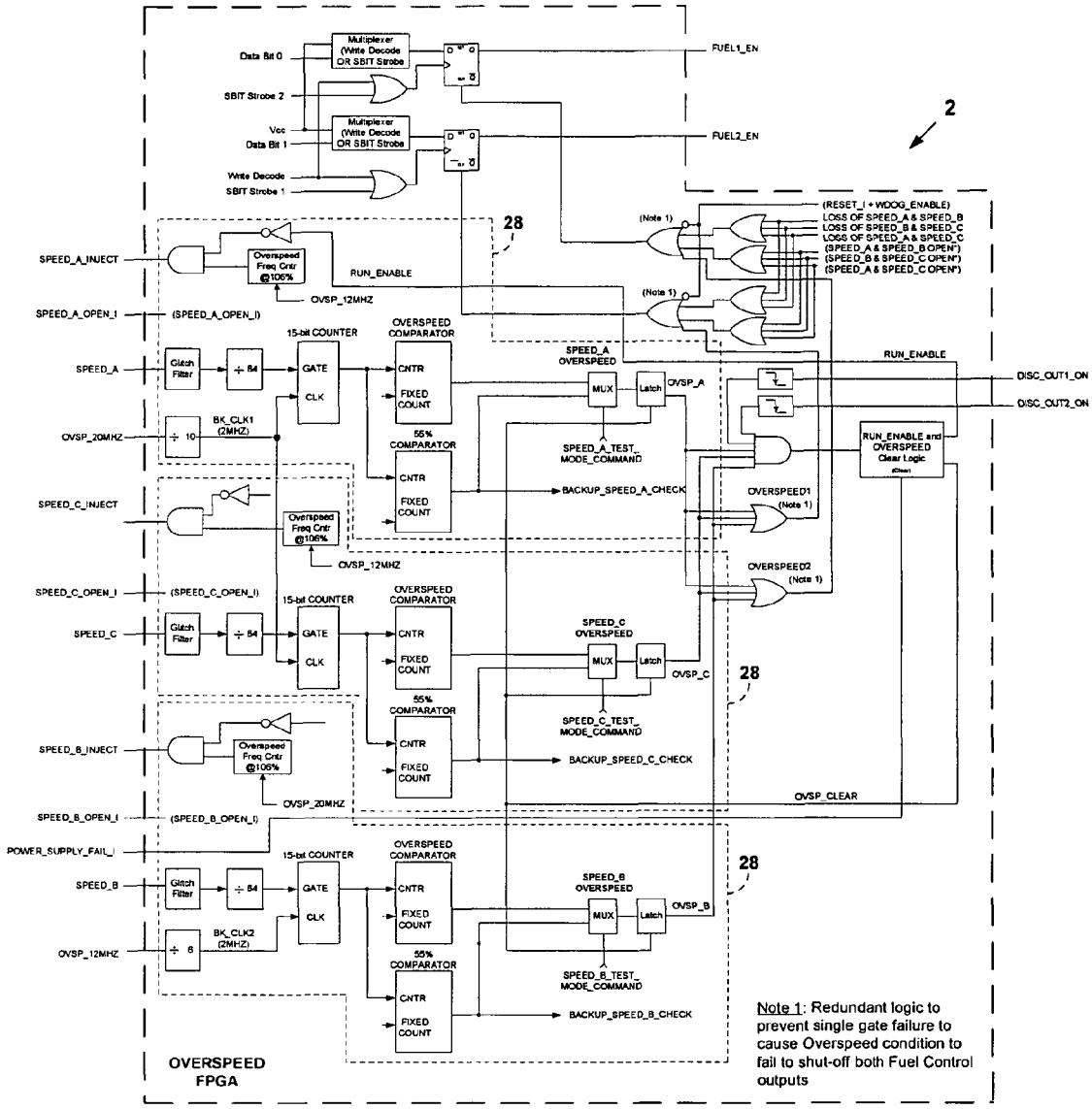
FIG. 3 is a detailed schematic diagram of a gas turbine overspeed protection system according to a possible embodiment of the invention.
Figure 3A:
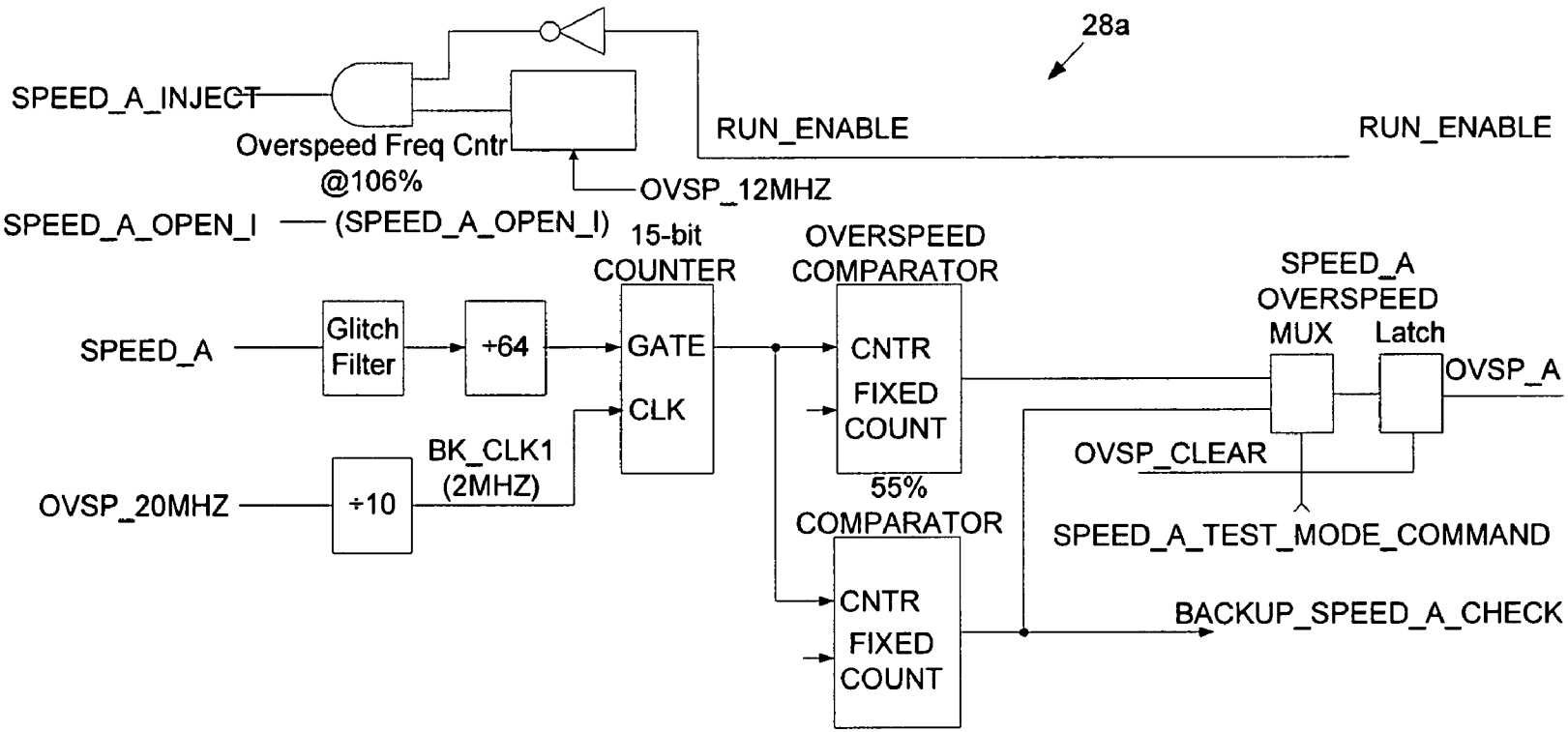
Figure 3B:
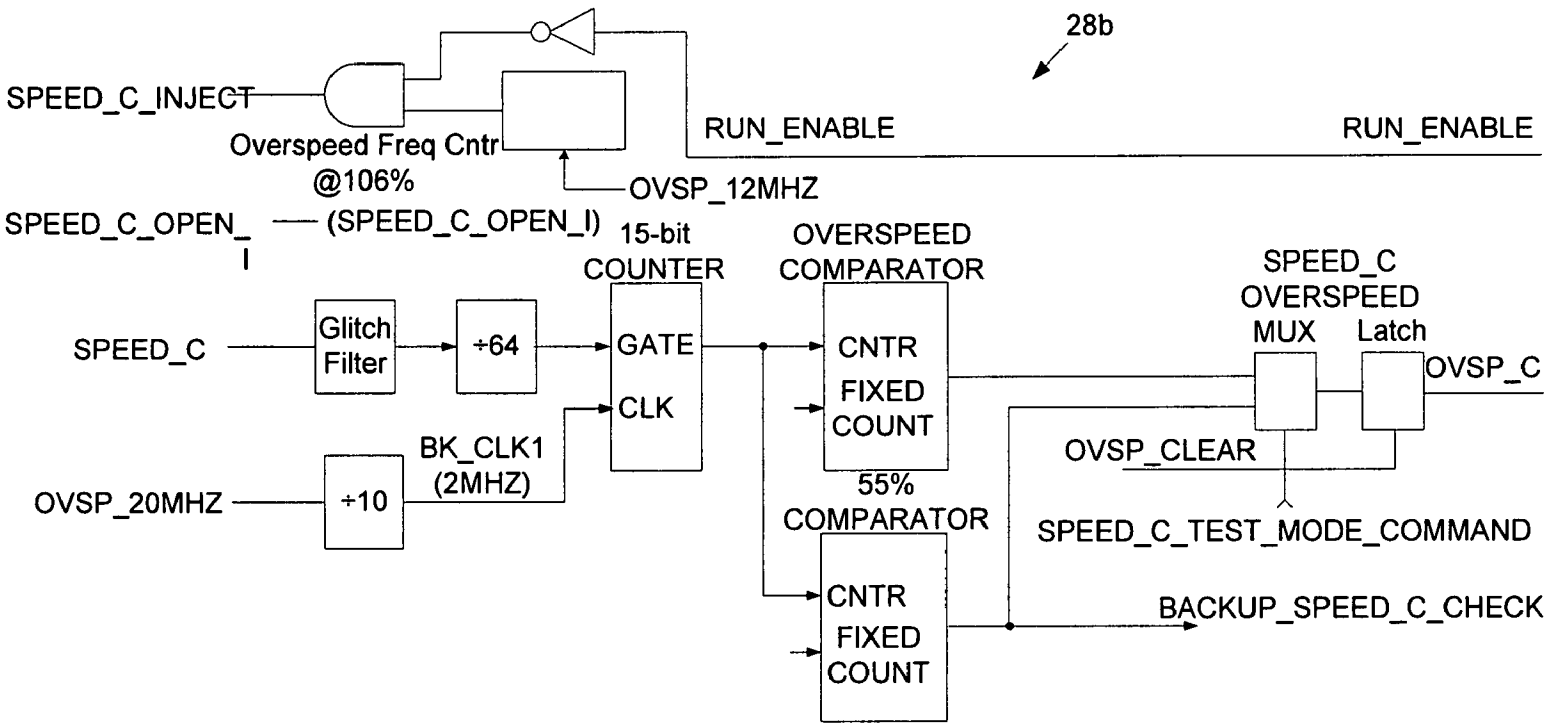
Figure 3C:
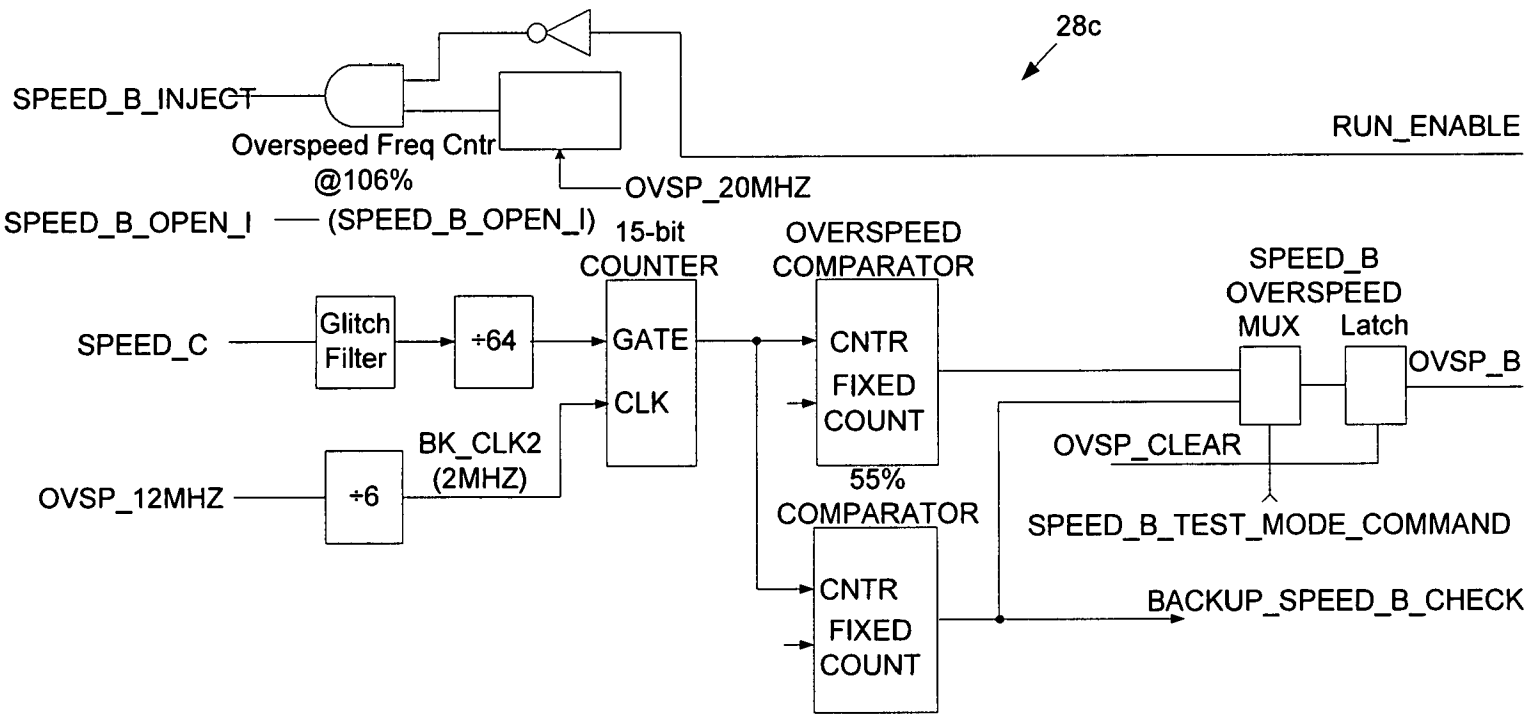
Figure 3D:
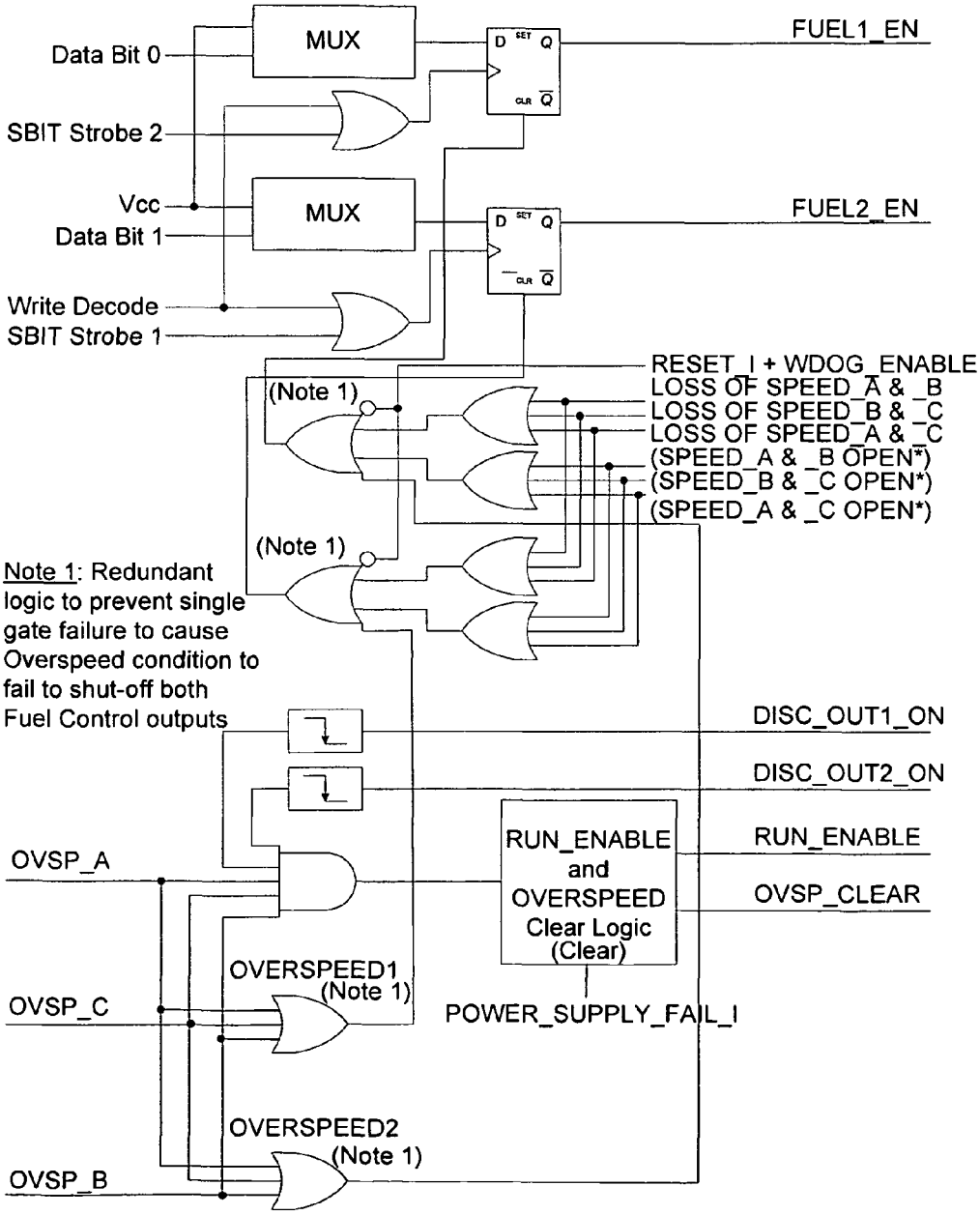

FIG. 3 is a detailed schematic diagram of a gas turbine overspeed protection system 22 as generally hereinbefore described in connection with FIG. 2. FIG. 3 shows the overspeed protection system 22 with three of the engine speed sensors 24 and three of the overspeed detection channels 28, with each engine speed sensor 22 dedicated to each overspeed detection channel 26. The gas turbine protection system 20 may comprise a modular field gate programmable array (FGPA) form with signals indicated in FIG. 3 as hereinafter described.

General Functional Requirements

The POWER_SUPPLY_FAIL_I='0' input shall clear RUN_ENABLE mode to the inactive state, with the RUN_ENABLE condition as defined hereinafter.

The RESET_I='0' input or the WDOG_ENABLE='0' input shall clear the FUEL1_EN and FUEL2_EN to logic '0' (their inactive states).

The RESET_I='0' input or the WDOG_ENABLE='0' input shall set both FM_TX_INH and FM INH_CMD outputs to logic '"1"' (this logic disables the Fuel Module of the engine).

The RESET_I='0' input shall clear all other flip-flop outputs to a logic "low".

Overspeed Condition

There shall be three Overspeed circuits (modules) to independently detect overspeed conditions on SPEED_A, SPEED_B, and SPEED_C.

The Overspeed module SPEED_A, the Overspeed module SPEED_B, and the Overspeed module SPEED_C shall be identical in function.

The Overspeed output from each Overspeed module shall be "OR'ed" to produce the following two internal signals: OVERSPEED1_I and OVERSPEED2_I.

The active "low" state of either OVERSPEED1_I or OVERSPEED2_I shall produce the OVERSPEED_CONDITION.

There shall be no single point logic gate failure within the FPGA that can prevent detection of an OVERSPEED_CONDITION and to disable both Fuel Control outputs.

Fuel Control Outputs

The two output pins FUEL1_EN and FUEL2_EN are the "Fuel Control Outputs".

Corresponding bit and address decode shall set the pins FUEL1_EN and FUEL2_EN.

A software write decode with a logic '1' shall set the Fuel Control to the active mode.

A software write decode with a logic '0' shall set the Fuel Control to the inactive mode.

The assertion of the OVERSPEED_CONDITION shall de-activate both Fuel Control Outputs.

The Software Write Decode to enable Fuel Control outputs shall remain inhibited until RUN_ENABLE is active.

Glitch Filtering

The clock for the Glitch Filter shall be 2 MHz.

The filter clock input for SPEED_A shall derive from the OVSP__20 MHZ signal.

The filter clock input for SPEED_B shall derive from the OVSP__12 MHZ signal.

There shall be three identical Glitch Filters for SPEED_A, SPEED_B, and SPEED_C inputs.

The Glitch Filter shall count four consecutive clocks of each speed input logic state before toggling the output of the Glitch Filter to the opposite state. Any incorrect logic state occurred during this time would reset the counter to zero and the process would restart.

Overspeed Protection and Latch

The Overspeed circuit shall be capable of monitoring the SPEED_A, SPEED_B, and SPEED_C inputs and cause an OVERSPEED CONDITION that is necessary to de-activate the Fuel Control outputs and to activate the Fuel Module Inhibit signals.

The Overspeed condition, once set, shall remain latched until software generates a CLEAR_OVERSPEED command.

The CLEAR_OVERSPEED shall be generated by a software write decode.

The CLEAR_OVERSPEED shall be capable of clearing the Overspeed condition only when all three speed inputs are below 55%.

Software shall be able to monitor the condition of the Overspeed FPGA by reading the Overspeed Status Register (see "OVSP Status" in Appendix A).

Overspeed Circuit Logic Requirements

The Speed counter shall monitor the value of the Speed Signal Input by a counting method comparing the unknown frequency with the reference clock. Using the Speed Input as a gate to count the reference clock, the number of reference clock is an indication of the period for which the gate is "open".

The Speed counter shall count a maximum of 64 consecutive periods of the speed input to determine the Overspeed condition. This is the PERIOD_SAMPLE_NUMBER, and the Speed Counter Gate is "close" at the end of this period.

The determination of whether or not the "Overspeed condition occurs" shall take place at the end of each PERIOD_SAMPLE_NUMBER of the speed input.

At the end of the PERIOD_SAMPLE_NUMBER of the speed input, the speed counter shall clear and shall restart counting the next set of PERIOD_SAMPLE_NUMBER within one period of the Speed input frequency.

Backup Clocks (BK_CLK1, BK_CLK2 and BK_CLK3) shall be the reference clock inputs to the Speed counter.

The BK_CLK1 clock shall derive from the OVSP__20 Mhz input clock.

The 20 MHz input clock shall be divided by 10 to obtain a 2.00 MHz clock to create BK_CLK1.

The BK_CLK2 clock shall derive from the OVSP__12 Mhz input clock.

The 12 MHz input clock shall be divided by 6 to obtain a 2.00 MHz clock to create BK_CLK2.

A comparator shall monitor the output of the each Speed Counters to detect a count that is equal to that of a selected Overspeed trip point.

At speeds lower than the Overspeed trip point, the counter will always count past the Overspeed trip point and the circuit will not set the "Overspeed" status flag.

As the speed goes up, at the end of each PERIOD_SAMPLE_NUMBER, the Speed Counter will end up with a count that is getting smaller (lower count) when compared with a fixed Count Reference.

No Overspeed: if the counter is equal to the Overspeed Trip Point count reference during the period for which the Speed Counter gate is "open", it shall clear the internally generated "Overspeed Flag".

Overspeed: if the counter is not equal to the Overspeed Trip Point count reference during the period for which the Speed Counter gate is "open", it shall set the internally generated "Overspeed Flag".

The OVERSPEED_CONDITION shall be determined at the end (falling edge) of the PERIOD_SAMPLE_NUMBER of the Speed input (when the Speed Counter is "close"). If the "Overspeed Flag" is not present at this time, then the OVERSPEED_CONDITION will remain de-asserted. Otherwise, if the "Overspeed" flag is present at this time, then the OVERSPEED_CONDITION Output will be asserted.

The clock to determine the OVERSPEED_CONDITION shall synchronise with the BK_CLK1 and BK_CLK2 such that the determination of the OVERSPEED_CONDITION will always take place when the counter is not changing.

Simulation results shall demonstrate that "overlap" timing between the PERIOD_SAMPLE_NUMBER and the Overspeed Trip Count output will not cause any miss of the OVERSPEED_CONDITION. Numerous test benches (test vectors) with varying Speed input at the Overspeed trip point may demonstrate this.

Loss of Speed Condition

Past the 55% rated speed, if the input speed signal goes to DC before the PERIOD_SAMPLE_NUMBER reaches the maximum count, there shall be a time out function to indicate LOSS_OF_SPEED on each speed sensor.

The logic shall wait for a time of at least 18 milliseconds from the last transition of the Speed input before timing out to indicate a LOSS_OF_SPEED on each speed sensor.

Loss of the SPEED_A input shall cause LOSS_OF_SPEED_A_CONDITION.

Loss of the SPEED_B input shall cause LOSS_OF_SPEED_B_CONDITION.

Loss of the SPEED_C input shall cause LOSS_OF_SPEED_C_CONDITION.

LOSS_OF_SPEED_A_CONDITION or LOSS_OF_SPEED_B_CONDITION or LOSS_OF_SPEED_C_CONDITION shall be latched with '1' only when no overspeed condition and speed input is changing from greater than 55% to DC condition (within 18 ms).

The assertion of both LOSS_OF_SPEED_C_CONDITION and LOSS_OF_SPEED_B_CONDITION shall generate the LOSS_OF_SPEED_CONDITION.

The assertion of both LOSS_OF_SPEED_A_CONDITION and LOSS_OF_SPEED_B_CONDITION shall generate the LOSS_OF_SPEED_CONDITION.

LOSS_OF_SPEED_CONDITION shall de-activate both Fuel Control outputs and shall activate the Fuel Module Inhibit signals.

LOSS_OF_SPEED CONDITION shall be latched until a Software Clear Command is issued. Only Write to register 0xC (data do not care) shall clear LOSS_OF_SPEED_CONDITION.

Once LOSS_OF_SPEED_CONDITION happens and until this condition is cleared, further LOSS_OF_SPEED detection shall be stopped for all the three speed inputs (the logic should not record another loss of speed for third speed if only two speed inputs caused the initial loss of speed).

The LOSS_OF_SPEED_CONDITION shall not have any effect on the OVERSPEED detection on the remaining speed input.

Overspeed Test Logic

Software shall have the capability to put the Overspeed circuitry into Test Mode.

Software shall be able to command SPEED_A, SPEED_B, and SPEED_C TEST_MODE_COMMAND separately.

Status bits shall confirm SPEED_A, SPEED_B, and SPEED_C TEST_MODE_COMMAND status.

In Test Mode, the corresponding Overspeed circuitry shall generate the OVERSPEED_CONDITION (Output pin and Status bits) at >55% of their rated speed instead of the normal overspeed trip point. (This will allow the external hardware to test the Fuel Control Outputs of being able to shut off fuel to the ENGINE during "shut down".)

>55% SPEED (Greater than 55% Speed) Status

Software shall have the capability to read a "55% Speed" status bit for each of the three Overspeed circuits.

Each status bit shall be set if the corresponding SPEED input is above 55% Speed.

The >55% SPEED status for the three speeds shall be available in as SPEED_A_GT__55, SPEED_B_GT__55, and SPEED_C_GT__55 in the OVSP Status Register.

The LOSS_OF_SPEED_A condition shall clear the SPEED_A_GT__55 bit in the OVSP Status Register.

The LOSS_OF_SPEED_B condition shall clear the SPEED_B_GT__55 bit in the OVSP Status Register.

The LOSS_OF_SPEED_C condition shall clear the SPEED_C_GT__55 bit in the OVSP Status Register.

Each status bit shall be cleared if the corresponding SPEED input is below 55% Speed.

Speed Probe Open

The input signal SPEED_A_OPEN_I shall indicate that the SPEED_A input is "open". Note that when the speed probe is open, SPEED_A can be a "high" or "low" depends on the external speed interface circuit.

The input signal SPEED_B_OPEN_I shall indicate that the SPEED_B input is "open". Note that when the speed probe is open, SPEED_A can be a "high" or "low" depends on the external speed interface circuit.

The input signal SPEED_C_OPEN_I shall indicate that the SPEED_C input is "open". Note that when the speed probe is open, SPEED_A can be a "high" or "low" depends on the external speed interface circuit.

The assertion of both SPEED_A_OPEN_I and SPEED_B_OPEN_I shall de-activate both Fuel Control outputs and shall activate the Fuel Module Inhibit signals.

The assertion of both SPEED_B_OPEN_I and SPEED_C_OPEN_I shall de-activate both Fuel Control outputs and shall activate the Fuel Module Inhibit signals.

The assertion of both SPEED_A_OPEN_I and SPEED_C_OPEN_I shall de-activate both Fuel Control outputs and shall activate the Fuel Module Inhibit signals.

It may be desirable to increase the number of engine overspeed detection paths or channels 28 to four in order to accommodate a variety of different main engine and auxiliary power unit aeronautical applications. With respect to each engine speed sensor 24, it may be desirable to add a series resistance to avoid loss or degradation of respective redundant engine speed signals due to electrical shorts. It may also be desirable to measure the engine speed sensor potential developed by each engine speed sensor 24 at the input to the engine controller as well as at the input to the overspeed detection system 22.

The described embodiments of the invention are only illustrative implementations of the invention wherein changes and substitutions of the various parts and arrangement thereof are within the scope of the invention as set forth in the attached claims.

The claimed invention is:

1. An overspeed protection system for a gas turbine engine, comprising:

three engine speed sensors that generate engine speed signals; and three engine overspeed detection channels, each overspeed detection channel comprising an overspeed detector that receives and generates an overspeed signal when it detects the engine speed signal exceeding a selected value of overspeed.

2. An overspeed protection system for a gas turbine engine, comprising:

a plurality of engine speed sensors that generate engine speed signals; and a plurality of engine overspeed detection channels, each overspeed detection channel comprising an overspeed detector that receives and generates an overspeed signal when it detects the engine speed signal exceeding a selected value of overspeed, a low amplitude engine speed signal detector that receives the engine speed signal from each engine speed detector and generates a termination signal to shut down the engine when it determines that the engine speed signal level is lower than a threshold level considered adequate for reliable speed detection, an intermediate speed detector that receives the engine speed signal from each engine speed detector and generates an intermediate speed signal when it detects the engine speed signal exceeding a selected value of intermediate speed, a multiplexer that generates an overspeed signal when it receives the overspeed signal from its associated overspeed detector in a normal mode and the intermediate speed signal from its associated intermediate signal detector in a test mode and an overspeed condition detector that receives the overspeed error signal from its associated multiplexer and generates an overspeed condition signal.

3. The overspeed protection system of claim 2, wherein at least one of the multiplexers switches to the test mode to initiate engine shutdown.

4. The overspeed protection system of claim 2, wherein the multiplexers switch to the test mode upon startup and the system injects a test signal in place of the engine speed sensor signal for each of the engine speed sensors that causes the intermediate speed detectors to generate the intermediate speed signals that in turn make the multiplexers generate overspeed error signals.

5. An overspeed protection system for a gas turbine engine, comprising:

a plurality of engine speed sensors that generate engine speed signals; and a plurality of engine overspeed detection channels, each overspeed detection channel comprising an overspeed detector that receives and generates an overspeed signal when it detects the engine speed signal exceeding a selected value of overspeed and a sensor output detector that receives the engine speed signal from each engine speed detector and generates a sensor output error signal upon the loss of the engine speed signal or a loss of speed in the engine speed signal.

6. An overspeed protection system for a gas turbine engine, comprising:

a plurality of engine speed sensors that generate engine speed signals; and a plurality of engine overspeed detection channels, each channel comprising an overspeed detector that receives and generates an overspeed signal when it detects the engine speed signal exceeding a selected value of overspeed;

wherein each of the engine speed sensors is dedicated to an associated one of the engine overspeed detection channels and each engine overspeed detection channel monitors the engine speed sensor signal of only its dedicated one of the engine speed sensors.

7. An overspeed protection system for a gas turbine engine, comprising:

a plurality of engine speed sensors that generate engine speed signals; and a plurality of engine overspeed detection channels, each channel comprising:

a low amplitude engine speed signal detector that receives the engine speed signal from each engine speed detector and generates a termination signal to shut down the engine when it determines that the engine speed signal level is lower than a threshold level considered adequate for reliable speed detection;

an overspeed detector that receives and generates an overspeed signal when it detects the engine speed signal exceeding a selected value of overspeed, an intermediate speed detector that receives the engine speed signal from each engine speed detector and generates an intermediate speed signal when it detects the engine speed signal exceeding a selected value of intermediate speed, a multiplexer that generates an overspeed signal when it receives the overspeed signal from its associated overspeed detector in a normal mode and the intermediate speed signal from its associated intermediate signal detector in a test mode, an overspeed condition detector that receives the overspeed error signal from its associated multiplexer and generates an overspeed condition signal, a sensor output detector that receives the engine speed signal from each engine speed detector and generates a sensor output error signal upon the loss of the engine speed signal or a loss of speed in the engine speed signal, and an engine speed error controller that generates a termination signal to stop the engine when it receives the sensor output error signal from its associated sensor output detector or the overspeed condition signal from its associated overspeed condition detector.

8. The overspeed protection system of claim 7, wherein at least one of the multiplexers switches to the test mode to initiate engine shutdown.

9. The overspeed protection system of claim 7, wherein the multiplexers switch to the test mode upon startup and the system injects a test signal in place of the engine speed sensor signal for each of the engine speed sensors that causes the intermediate speed detectors to generate the intermediate speed signals that in turn make the multiplexers generate overspeed error signals.

10. The overspeed protection system of claim 7, wherein said system is hardware-based.

11. The overspeed protection system of claim 7, wherein each engine overspeed detection channel monitors the engine speed sensor signals of all of the engine speed sensors.

12. The overspeed protection system of claim 7, wherein each of the engine speed sensors is dedicated to an associated one of the engine overspeed detection channels and each engine overspeed detection channel monitors the engine speed sensor signal of only its dedicated one of the engine speed sensors.

13. A method of protecting a gas turbine engine from an overspeed condition, comprising the steps of:

generating a plurality of independent engine speed signals;

propagating each engine speed signal through a different engine speed signal overspeed detection path;

detecting the level of at least one engine speed signal in at least one engine speed signal overspeed detection path;

generating an overspeed signal when any detected engine speed signal level exceeds a selected value that represents an overspeed condition;

testing the integrity of a plurality of independent engine speed signal sources that generate the engine speed signals;

testing the integrity of the engine speed signal overspeed detection paths; and blocking startup of the engine upon failure of a selected number of engine speed signal sources and overspeed detection paths.

14. The method of claim 13, further comprising the step of generating a termination signal to shut down the engine when the engine speed signal level is lower than a threshold level considered adequate for reliable speed detection.

15. The method of claim 13, wherein the plurality of independent engine speed signal sources comprise two sources and the engine speed signal overspeed detection paths comprise two detection paths.

16. A method of protecting a gas turbine engine from an overspeed condition, comprising the steps of:

generating three independent engine speed signals;

propagating each engine speed signal through a different one of three engine speed signal overspeed detection paths;

detecting the level of at least one engine speed signal in at least one engine speed signal overspeed detection path; and generating an overspeed signal when any detected engine speed signal level exceeds a selected value that represents an overspeed condition.

* * * * *